United States Patent [19]

Wyner et al.

[11] 4,445,073

[45] Apr. 24, 1984

[54] INTIMATE CONTACT STARTING AID FOR ARC LAMPS

[75] Inventors: Elliot F. Wyner, Peabody, Mass.; Timothy Gehling, Hampton, N.H.

[73] Assignee: GTE Products Corporation, Stamford, Conn.

[21] Appl. No.: 360,278

[22] Filed: Mar. 22, 1982

[51] Int. Cl.[3] ..... H01J 7/44; H01J 17/34; H01J 19/78; H01J 29/96

[52] U.S. Cl. ..... 315/56; 315/60; 313/594; 313/620

[58] Field of Search ..... 315/56, 60, 204, 330; 313/594, 620

[56] References Cited

U.S. PATENT DOCUMENTS

| | | | |
|---|---|---|---|
| 3,714,494 | 1/1973 | Nakamura | 315/60 |
| 4,037,129 | 7/1977 | Zack et al. | 313/594 |
| 4,316,122 | 2/1982 | Yamazaki et al. | 313/594 |

*Primary Examiner*—Saxfield Chatmon
*Attorney, Agent, or Firm*—William H. McNeill

[57] ABSTRACT

A high pressure sodium discharge lamp employs a starting aid allowing the use of increased xenon pressure for higher efficacy. The starting aid is positioned far enough from the ends of the electrodes so that end blackening does not attenuate the starting pulse and render the lamps impossible to start after they have been aged over 100 hours.

3 Claims, 1 Drawing Figure

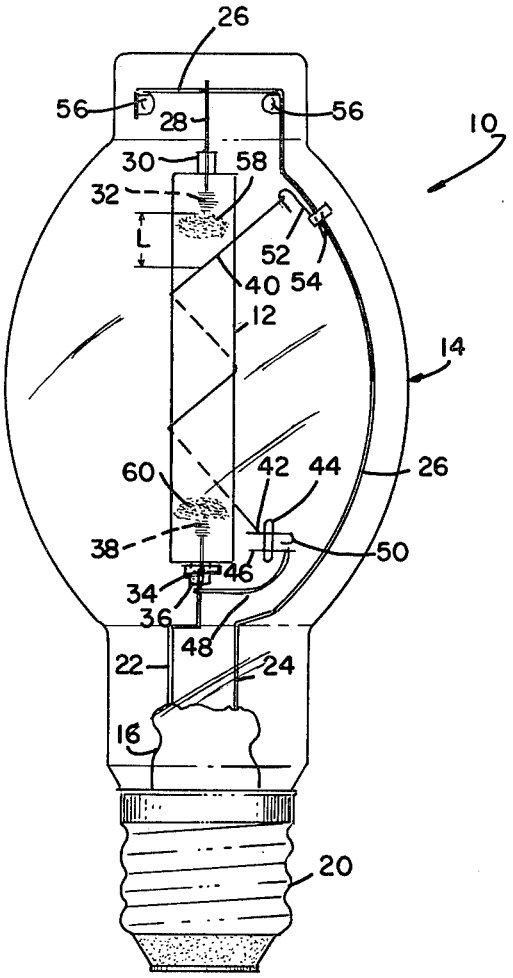
26
56
28
56
10
30
58
32
L
52
54
40
12
14
60
42
44
26
38
50
46
34
36
48
22
24
16
20

INTIMATE CONTACT STARTING AID FOR ARC LAMPS

TECHNICAL FIELD

This invention relates to arc discharge lamps and more particularly to high pressure sodium (HPS) lamps. Still more particularly the invention relates to a starting aid for such lamps.

BACKGROUND ART

Arc discharge lamps of the high pressure sodium variety comprise an arc tube, usually of alumina, which is hermetically sealed and has an electrode in each end. Within the arc tube are quantities of mercury and sodium and a fill gas which is selected from the rare gases but is usually xenon at a pressure of 14–30 torr.

HPS lamps typically are started with a high voltage pulse in the range of 2 KV–3 KV, with a one microsecond width. This pulse is derived from the ballast, and, in the United States, the range and magnitude of this pulse are specified by ANSI.

It is known that the luminous efficacy (usually denoted as lumens per watt) of HPS lamps can be increased by increasing the xenon pressure (see U.S. Pat. No. 3,248,590).

However, it is also known that increasing the xenon pressure raises the breakdown voltage of the lamp to the point that the standard ANSI pulse fails to start the lamp.

One means to overcome this deficiency is the use of a starting aid, and several forms of such aids have been suggested—see, for example, Journal of the Illuminating Engineering Society, January 1978, pg. 125.

Other forms of starting aids are shown in U.S. Pat. Nos. 4,179,640; 4,137,483; and 4,146,813. While the starting aids described above work well enough on new lamps, problems with starting appear as the lamps age.

DISCLOSURE OF THE INVENTION

It is, therefore, an object of this invention to obviate the disadvantages of the prior art.

Yet another object of the invention is enhanced starting of HPS lamps.

These objects are accomplished, in one aspect of the invention, by the provision of a high pressure sodium lamp having a xenon pressure of 75 torr which includes a starting aid comprised of a helical wire wrapped about the arc tube. The starting aid is positioned so that the last intimate contact it makes with the arc tube occurs at a given axial distance from the internal end of the arc tube electrode, this distance being sufficient to enhance starting in aged lamps.

BRIEF DESCRIPTION OF THE DRAWING

The single FIGURE illustrates an arc discharge lamp employing the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity, there is shown an arc discharge lamp 10 having a hermetically sealed alumina arc tube 12 disposed within an outer glass jacket 14 which is sealed at the bottom of the flare of the usual stem press 16. The usual metal threaded base 20 is also provided. Lead-in wires 22 and 24 are supported in the stem press 16 and are connected to the base 20 in the usual manner.

Support rod 26 is welded to lead-in wire 24 and extends roughly from the bottom to the top of the lamp 10. The upper end of arc tube 12 is supported by a rod 28 which is welded between support rod 26 and a niobium tube 30. Tube 30 is sealed through the upper end of arc tube 12 and supports electrode 32 therewithin.

The lower end of arc tube 12 is supported by a metal strap 34 which securely encircles lower niobium tube 36 and is welded to lead-in wire 22. Tube 36 is sealed through the lower end of arc tube 12 and supports electrode 38.

Encircling the arc tube 12 is a starting aid 40 made of refractory metal wire, such as tungsten or molybdenum. Starting aid 40 is welded to a support wire 42 which is embedded in a quartz rod 44.

Quartz rod 44 is supported by another support wire 46 embedded therein. Wire 46 is welded to a support rod 48 which is welded to lead-in wire 22. A "U" shaped bimetallic switch 50 is welded to wire 42 and makes pressure contact, at room temperature, with wire 46. Thus, when the lamp is initially energized, starting aid 40 has the same voltage as electrode 38. The starting aid 40 is electrically removed from the circuit by the opening of switch 50, which occurs after a few seconds or minutes when switch 50 is heated to its activating temperature, for example, 105° C., by the heat generated by the lamp.

The other end of starting aid 40 is connected to a supporting member 52 which is fixed in an electrical insulator 54 which in turn is affixed to support rod 26. Preferably, supporting member 52 is a spring-like material which supplies tension to maintain starting aid 40 in position.

Bulb spacers 56, mounted on support rod 26, engage the inner wall of jacket 14 and aid in positioning arc tube 12.

The starting aid 40 makes its first intimate contact at one end of arc tube 12 and its last intimate contact at the other end of arc tube 12. The last intimate contact occurs at a given axial spacing from the internal terminus of electrode 32. In the drawing this spacing is denoted by the distance "L" which preferably is about 5 mm to 15 mm. Unlike prior art lamps employing helical starting aids wherein the "L" dimension is smaller than specified herein, the lamps employing the spacing of this invention continued to start well even after 100 hours of aging.

Data for our lamps are shown in Table I.

TABLE I

| LAMP NUMBER | "L" (mm) | STARTING VOLTAGE INITIAL (KILOVOLTS) | STARTING VOLTAGE 100 HOUR (KILOVOLTS) |
|---|---|---|---|
| S1 | 12.9 | 3.10 | 3.25 |
| S2 | 8.1 | 2.60 | 3.25 |
| S3 | 1.6 | 2.65 | * |
| S4 | −2 | 3.35 | * |

*Will not start.

The means for testing the lamps were as follows: The lamps, in series with a 1.5 amp current limiting inductor, were connected to a 140 volt a.c. power supply. A variable magnitude pulse of approximately one microsecond pulse width was applied each half cycle. In column 2 of Table I is shown the spacing "L." Column 3 shows the starting voltage for room temperature lamps after they had been aged 30 minutes. As can be seen from the table, the range of breakdown voltages is from 2.6 KV to 3.35 KV. In column 4 are the breakdown voltages measured in a similar fashion after the lamps had been aged for 100 hrs. on a standard 250 watt HPS ballast. From the data, it can be seen that lamps S1 and S2, employing the starting aid spacing of the invention, continued to start within the same voltage as initially. The other two lamps, S3 and S4, employing the smaller spacing of the prior art, would not start. Further tests have shown that the latter two lamps would not break down even with a 4.2 KV pulse. The negative "L" figure for lamp S4 indicates that the starting aid overlapped the electrode.

It is believed that the explanation for starting problems of high pressure sodium lamps employing a high xenon pressure has been discovered. The discovery relates to a problem known as end blackening which occurs in all arc discharge devices. The end blackening originates from metals, primarily tungsten, sputtered and evaporated from the electrodes and deposited upon the interior of the arc tube. Such an area is shown in the drawing by the stippled areas 58 and 60. The blackening always occurs adjacent the electrodes. This deposited material raises the electrical conductivity of the arc tube wall; and, when it progresses the distance between the end or terminus of the electrode and the starting aid, the pulse voltage in the gas between the inside wall and the electrode is attenuated, and breakdown does not occur. Since end blackening increases with lamp aging, a progressively higher starting pulse voltage is needed. In a conventional ballast, this increasingly high pulse voltage is not available, and the lamps do not start once the end blackening has reached the starting aid.

The arc tubes employed in the lamps tested herein had an inside diameter of 7.3 mm and a cavity length of 52 mm. Surprisingly, the lamps S1 and S2, having the longer "L," did not show an initial higher starting voltage than those lamps employing a short "L."

Thus, there has now been found and described herein a means of utilizing the higher efficacy of HPS lamps employing an increased xenon pressure. Lamps using the instant invention will start on a standard ANSI pulse, both initially and after long use.

While there have been shown and described what are at present considered to be the preferred embodiments of the invention, it will be apparent to those skilled in the art that various changes and modifications can be made herein without departing from the scope of the invention as defined by the appended claims.

We claim:

1. A high pressure sodium discharge lamp comprising: an elongated, hermetically sealed arc tube; a first electrode sealed in one end of said arc tube and extending thereinto; and a second electrode sealed into the opposite end of said arc tube and extending thereinto; said arc tube containing effective amounts of mercury, sodium and xenon at a pressure of above 75 torr to provide an effective light output when said lamp is operated; and a starting aid in the form of a wire helically wrapped about said arc tube, said starting aid being detachably electrically connected to said first electrode and making a first intimate contact with said arc tube adjacent said first electrode and a last intimate contact with said arc tube adjacent said second electrode, said last intimate contact occuring at a given axial spacing from the internal terminus of said second electrode, said given axial spacing being sufficient to enhance starting in an aged lamp.

2. The lamp of claim 1 wherein said given axial spacing is from about 5 mm to about 15 mm.

3. The lamp of claim 2 wherein said wire is tungsten.

* * * * *